United States Patent [19]

Gustavsson

[11] Patent Number: 4,592,193

[45] Date of Patent: Jun. 3, 1986

[54] APPARATUS FOR PACKAGING RESILIENTLY COMPRESSIBLE ARTICLES

[76] Inventor: Olov E. Gustavsson, Svartbrödragatan 9F, Kungälv, Sweden, S-442 00

[21] Appl. No.: 523,756

[22] Filed: Aug. 16, 1983

[30] Foreign Application Priority Data

Aug. 26, 1982 [SE] Sweden ..... 8204896

[51] Int. Cl.[4] ..... B65B 63/02

[52] U.S. Cl. ..... 53/530; 53/550

[58] Field of Search ..... 53/439, 524, 526, 529, 53/530, 550, 574, 575, 576

[56] References Cited

U.S. PATENT DOCUMENTS

| | | | |
|---|---|---|---|
| 3,274,746 | 9/1966 | James et al. | 53/22 |
| 3,319,394 | 5/1967 | Talalay et al. | 53/439 |
| 3,581,876 | 6/1971 | Keith | 53/526 X |
| 3,606,726 | 9/1971 | Spertus et al. | 53/529 X |
| 3,660,964 | 5/1972 | Willis et al. | 53/524 |
| 3,792,564 | 2/1974 | Brady, Jr. | 53/124 |
| 3,837,138 | 9/1974 | Terry | 53/24 |
| 3,919,739 | 11/1975 | Kawai | 53/530 X |
| 4,328,655 | 5/1982 | Spencer et al. | 53/529 X |

FOREIGN PATENT DOCUMENTS

| | | | |
|---|---|---|---|
| 252875 | 7/1964 | Australia | 53/530 |
| 1417082 | 12/1975 | United Kingdom | 53/530 |

*Primary Examiner*—John Sipos
*Assistant Examiner*—Steven P. Weihrouch
*Attorney, Agent, or Firm*—Merchant, Gould, Smith, Edell, Welter & Schmidt

[57] ABSTRACT

Apparatus for providing resiliently compressible articles, which by being compressed have been lended a considerably reduced volume, with a casing formed of heat sealable pliable sheet material preventing the articles from regaining their original volume. The articles are first precompressed to a volume which is smaller than said reduced volume. The precompressed articles are thereafter introduced into a tube which is formed of a lengthy web of pliable sheet material by heat sealing overlapping longitudinal margin portions of the web so as to unite them. The articles introduced into the tube are prevented from expanding to said reduced volume, in which they fill out the tube, until the heat sealing seam of the tube has attained sufficient strength. The tube can be closed between the introduced articles by transverse heat sealing seams.

4 Claims, 8 Drawing Figures

APPARATUS FOR PACKAGING RESILIENTLY COMPRESSIBLE ARTICLES

BACKGROUND OF THE INVENTION

1. Field of the Invention

This invention concerns an apparatus for providing resiliently compressible articles, which have been lended a considerably reduced volume as the result of being compressed, with a casing formed of heat sealable pliable sheet material, said casing preventing the articles from regaining their original volume.

2. Description of the Prior Art

It is known to compress porous, resilient articles in connection with enclosing such articles in casings of various types. As a result of this, substantial space can be gained in connection with storing and transporting the articles. However, known apparatus for applying this technology have not operated very rationally and have had low capacity which has resulted in a high packaging cost.

Furthermore, apparatus for packaging many different types of goods are known, in which the casings of the articles are formed by portions of a tube which successively is lended the shape of a long web of heat sealable sheet or film material supplied to the apparatus, with the longitudinal edge portions of said material being joined by heat sealing. Apparatus of the last-mentioned type generally have high capacity which provides a very moderate packaging cost. However, as far as is known, no one has hitherto managed to provide an apparatus having these advantages and being adapted for packaging resiliently compressible articles in a compressed state.

SUMMARY OF THE INVENTION

The primary object of the invention is to provide apparatus of the type disclosed above.

With solely the mentioned means in combination the articles, when leaving the apparatus, will be enclosed after each other in a continuous tube which in its entire length has an open cross section. This is not always satisfactory, even if the tube easily can be severed afterwards so as to form sheath-like casings for the individual articles or small groups thereof, said casings being open at their ends. It is frequently desired that the articles, when they leave the apparatus, be enclosed in casings which are closed at least at one end and are separate from each other.

Additional features of preferred embodiments of the apparatus in accordance with the invention will be seen from the following description and from an embodiment illustrated in the accompanying drawings.

BRIEF DESCRIPTION OF THE DRAWINGS

In the drawings

FIG. 5 shows a side view of a device comprising the coordinated means for shaping the casing-forming tube and for introducing the precompressed articles into the latter on a scale which also is enlarged but is different, whereas

DESCRIPTION OF THE PREFERRED EMBODIMENT

Figure 1:
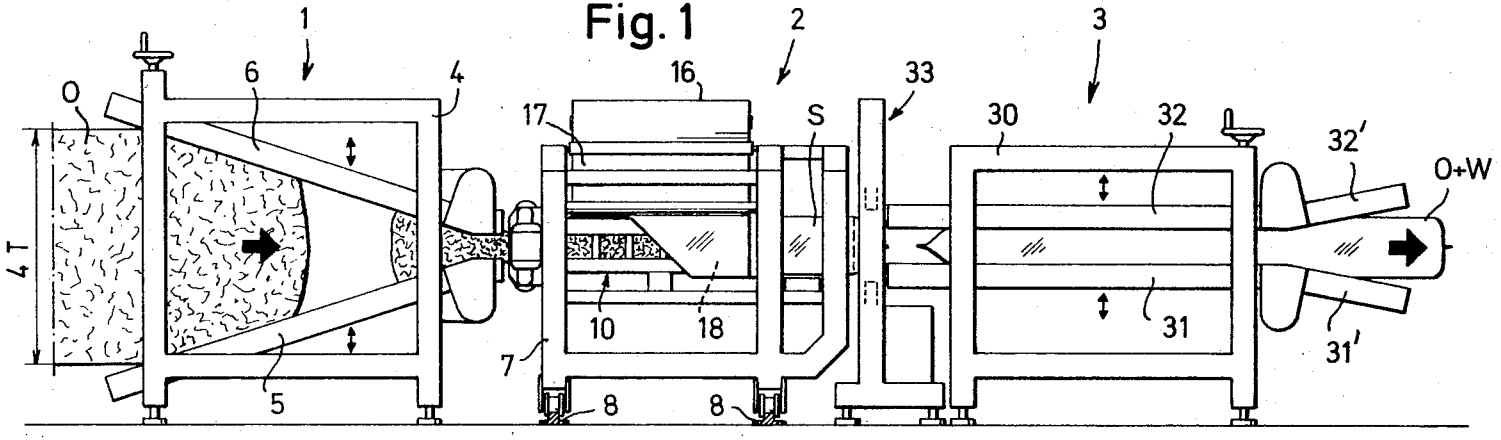
FIG. 1 shows a side view of an apparatus in accordance with the invention.
Figure 8:
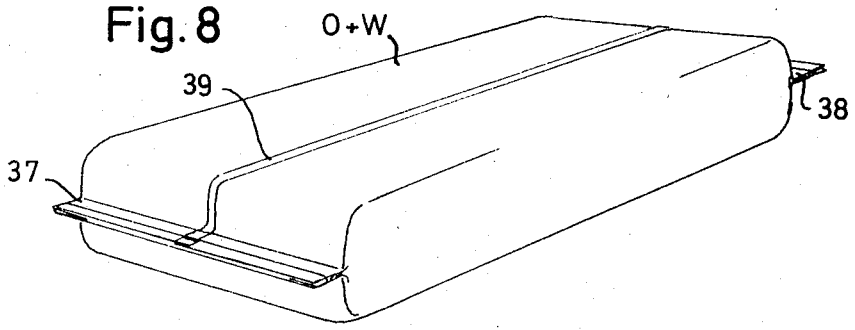
FIG. 8 shows a perspective view of an example of an article with reduced volume whose packaging is completed.

The apparatus illustrated in FIG. 1 comprises three aligned sections 1, 2 and 3, through which the articles O, which are to be packaged and which are assumed to be resiliently compressible, are successively advanced at predetermined mutual intervals in a direction from left to right for exiting at the right end of the apparatus with a considerably reduced volume and provided with a casing W formed of a heat sealable plastic film (FIG. 8) which prevents them from regaining their original volumes.

In the left apparatus section 1 means are included so as to—during the advancing of the articles O from left to right—subject said articles to a precompression in vertical direction to a volume which is still smaller than the reduced volume which the completely packaged articles are desired to have at the right outlet end of the apparatus. These precompression means comprise two belt conveyors, a lower belt conveyor 5 and an upper belt conveyor 6, supported by a stationary frame 4 and facing each other, said conveyors being driven synchronously in the common feed direction in appropriate manner and converging in said direction. In the illustrated case the two belt conveyors 5 and 6 are adjustable with respect to each other and to the frame 4 so that they may be used for precompressing articles having different cross sections to a thickness (height) which may be selected within specific limits.

Figure 7:
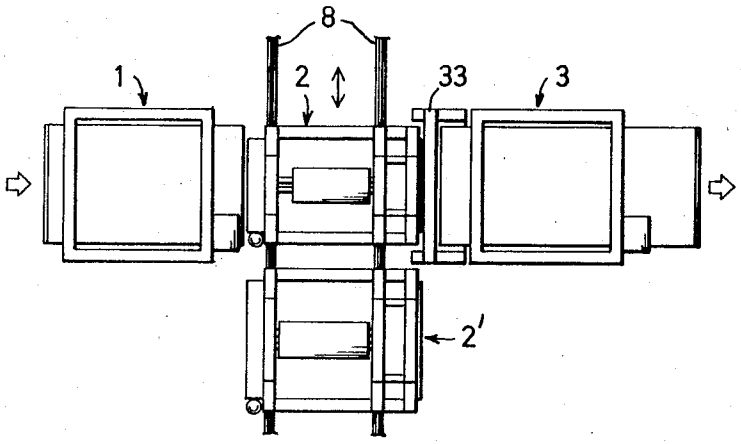
FIG. 7 diagrammatically shows a plan view of an apparatus in accordance with the invention which has been designed for packaging compressed articles in tubes having different cross sections. Finally.

In the intermediate apparatus section 2 there are on one hand included means for successively forming a tube S from a delivered extended web of a casing-forming heat sealable plastic film material, with the cross section of said tube being adapted to receive the precompressed articles O and to prevent the latter from expanding more than to the reduced volume desired at the final stage, and on the other hand means for introducing the precompressed articles successively into said tube. Both of these groups of means are supported by a frame 7 which in the illustrated case is carried on wheels and is movable in the transverse direction of the apparatus along a runway represented by two rails 8 (FIGS. 1 and 7, respectively).

Figure 5:
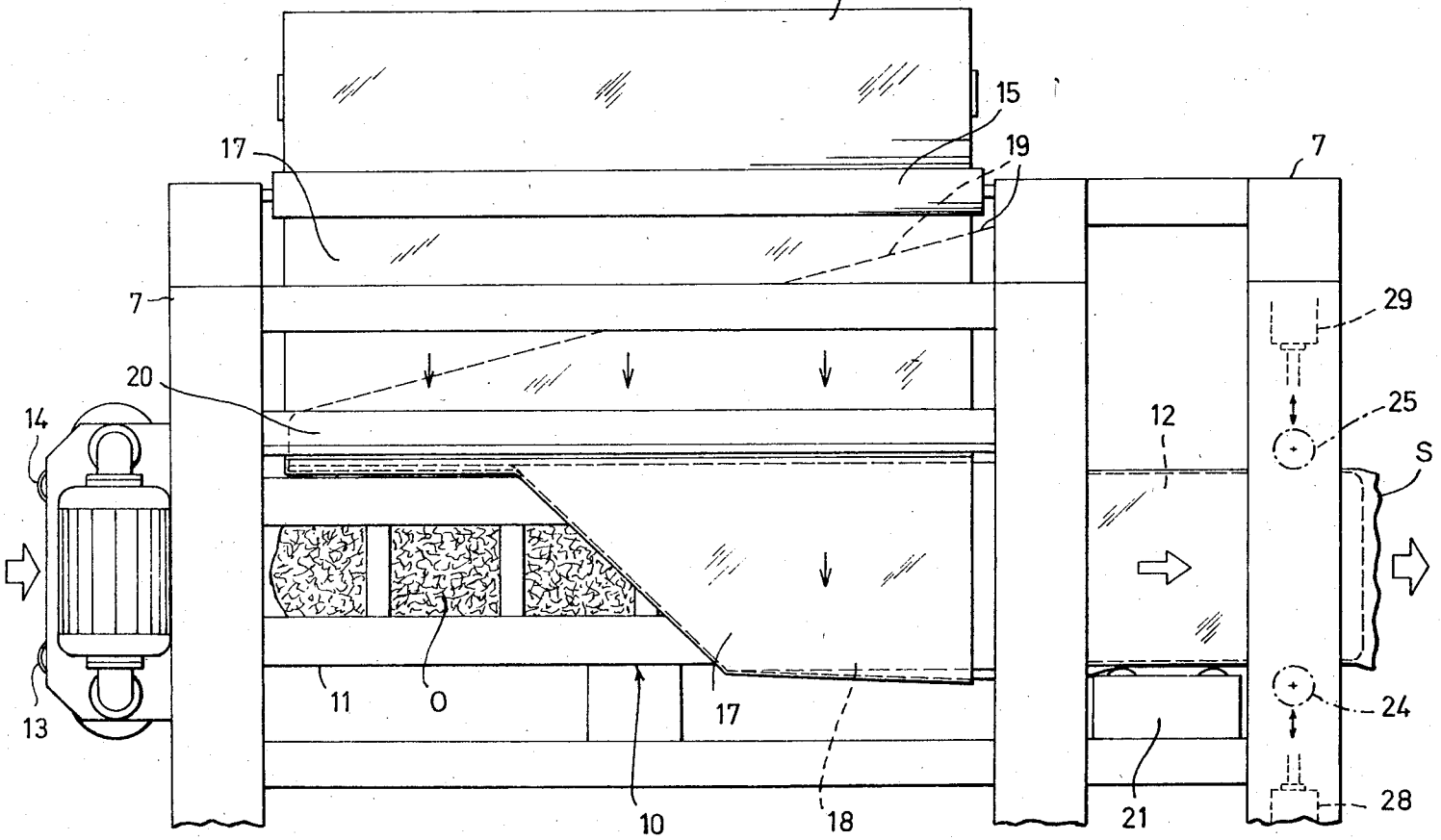
Figure 6:
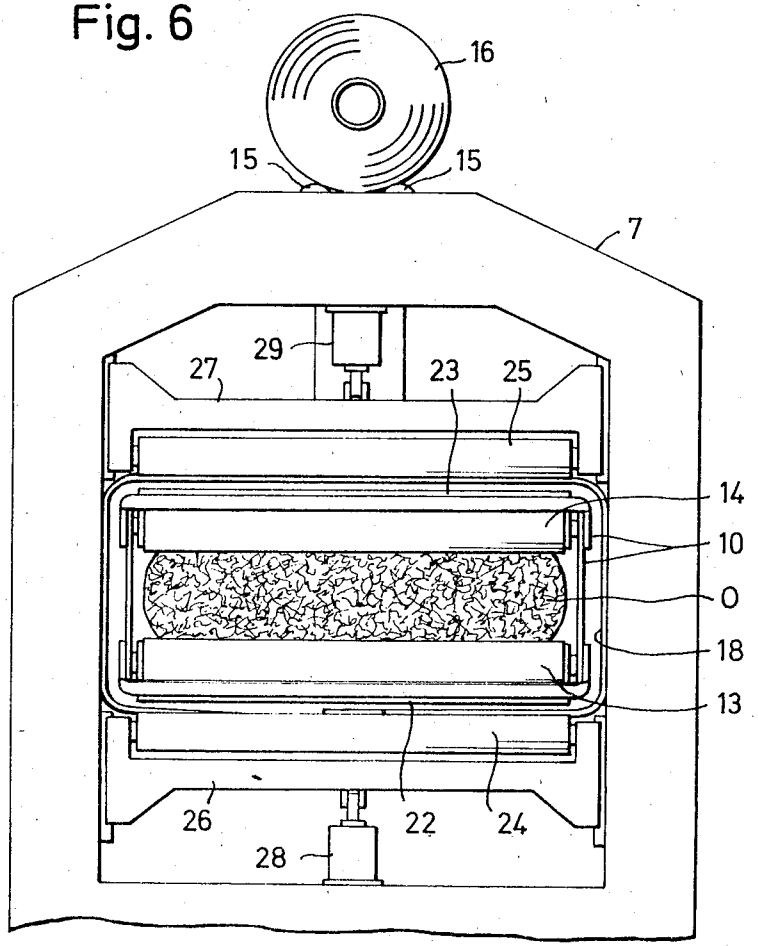
FIG. 6 shows the device of FIG. 5 as viewed from the right.

The means for introducing the precompressed articles O delivered from apparatus section 1 into tube S comprise an elongate, substantially tubular nozzle 10 having approximately rectangular cross section (see FIG. 6) and being supported solely at its left inlet end portion 11, with its right outlet end portion 12 extending freely a substantial distance within frame 7. The cross section of the nozzle is the same in the entire length of at least the free outlet end portion 12. Inside of this nozzle 10 there are positioned two belt conveyors, a lower one 13 and an upper one 14, which face each other and are driven synchronously in a common feed direction, from left to right in the respective FIGS. 1, 2, and 5 of the drawings. These two belt conveyors run parallel to each other within nozzle 10 in its entire length, but in front of the inlet end portion of the nozzle they converge slightly in the feeding direction in order more easily to capture the articles coming from apparatus section 1.

In their turn the means for shaping the tube S comprise a pair of rollers 15 mounted at the top of frame 7 and being adapted to support a roller 16 which may be replaced when necessary and which is formed of a double-folded web 17 of the plastic film from which the tube is to be shaped. The film web is folded at the end of roller 16 which faces apparatus section 1. Furthermore the tube shaping means comprise a substantially sheath-shaped deflection member 18 which encircles nozzle 10 with a small spacing so as to spread out web 17 therearound and to bring together the two free longitudinal margin portions of the web at the underneath side of the outlet end portion 12 of the nozzle so that they overlap each other. Deflection member 17 is formed of a plate which when spread out essentially has the form of a right-angled isosceles triangle and which has been bent along four lines parallel to the bisector of the right angle in such manner that the intermediate portion of the plate, which is symmetric with respect to said bisector, forms an upper wall having a right-angled apex whereas the portions of the plate located closest outside of the intermediate portion from trapeze-shaped side walls and the two remaining flap-like corner portions form a lower wall together. Said flap-like plate corner portions partially overlap each other with a small mutual spacing within this lower wall so that the two free outer longitudinal margin portions of web film 17 will cover each other at least a few centimeters.

On its top side deflection member 18 is provided with a central longitudinal cam 19 which not only serves to carry the deflection member but also forms a divider for the two layers of the double-folded film path 17, said layers being brought down each on one side of cam 19 and not being permitted to spread out in the opposite direction over and around deflection member 18 until after having passed inside of a pair of guide ribs 20 placed on opposite sides thereof. It should be clear that deflection member 18 can only be supported by frame 7 within an area disposed to the right of film web 17 in FIGS. 1 and 5 and that cam 19 comprises a valuable aid in securing it in its position freely encircling nozzle 10.

The means for shaping tube S also include a device 21 for joining the two longitudinal overlapping margin portions of film web 17 disposed around nozzle 10 by heat sealing as said web leaves deflection member 18 and at the same rate. This device 21, which can be of any known type, for example a device operating with infrared radiation, is disposed below the free outlet end portion 12 of nozzle 10 as close as possible adjacent to that end of deflection member 18 where film web 17 leaves said member. Thus, after having passed device 21 film web 17 will have become converted into a substantially continuous tube S which encircles the outer end of outlet end portion 12 of nozzle 10 and which has an elongate heat sealed seam located at the bottom side of the nozzle.

However, as long as the temperature of this seam and its border areas still is high after the heat sealing operation the strength is low and it can in reality—depending on the nature and thickness of the plastic film and on the cooling conditions—take many seconds and in some cases up to half a minute or more until at least approximately full strength has been achieved by the heat sealed seam, i.e. until the seam and its border areas no longer rupture when the tube is subjected to the expansion forces of the enclosed articles.

Figure 4:
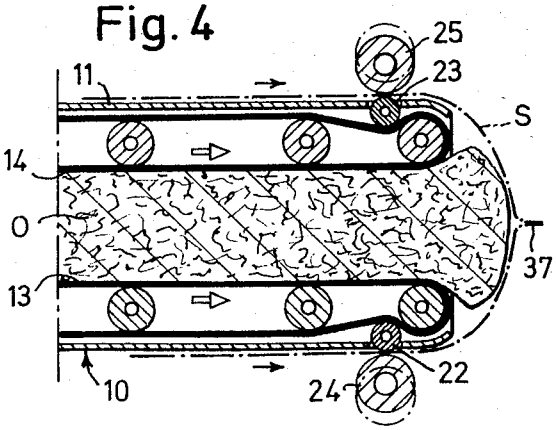
FIG. 4 shows a fragmentary longitudinal section of the outlet end portion of a nozzle on an enlarged scale, said nozzle being included in the means for introducing the articles into the tube.
Figure 3:
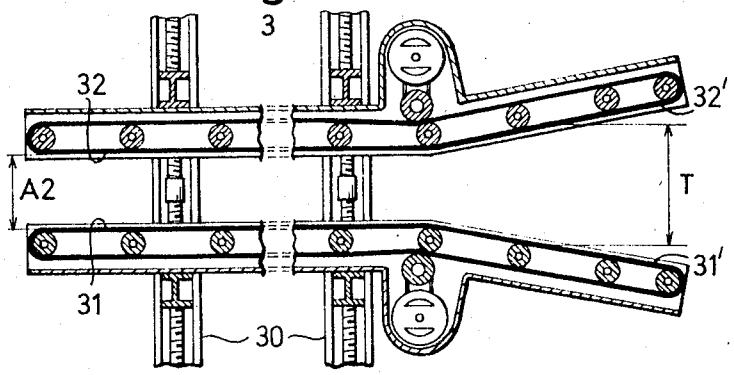
FIG. 3 shows a shortened and simplified longitudinal section through the means included in the apparatus for controlling the expansion of the articles introduced into the tube.

Means are disposed in the vicinity of the outer end of the outlet end portion 12 of nozzle 10 for selectively advancing tube S which has been shaped around nozzle 10. These means comprise two feed rollers 22 and 23 (FIG. 4), both of which are mounted in nozzle 10 and extend transversely thereto and one of which 22 is exposed on the flat bottom side of the nozzle whereas the second one 23 is exposed on the flat top side of the nozzle. The lower feed roller 22 is driven by the lower belt conveyor 13 in the nozzle by being engaged by its returning run whereas the upper feed roller 23 is driven by the upper belt conveyor 14 in corresponding manner. When the two belt conveyors 13 and 14 operate, the two feed rollers 22 and 23 are driven synchronously in directions opposite to each other, the lower one clockwise and the upper one counter-clockwise in FIG. 4. However, the feed rollers project so insignificantly on the outside of nozzle 10 that tube S, which only encircles the nozzle fairly loosely in order to slide easily, is not affected unless it is urged into engagement with them. This occurs with the aid of two pressure rollers 24 and 25, each being mounted in an individual yoke 26 and 27, respectively, said yokes being guided in frame 7 (FIG. 6) and being capable of being urged against nozzle 10 in directions opposite to each other by means of compressed air cylinders 28 and 29, respectively. Selective advancing of tube S is brought about by concurrently causing the two pressure rollers 24 and 25 to be urged against feed rollers 22 and 23, said advancing being cut off immediately when the pressure rollers become separated.

In the remaining apparatus section 3 there are included means for controlling the expansion of the articles introduced into tube S in such manner that the tube is not subjected to the expansion forces of the articles until its heat sealed longitudinal seam has attained satisfactory strength. These means include two belt conveyors, a lower one 32 and an upper one 32, supported by a stationary frame 30 and facing each other, said conveyors being adapted to be driven synchronously and in the illustrated case being adjustable relative to each other and to frame 30 for being utilized for articles having different cross sections in their compressed states. Along the greater part of their lengths the two belt conveyors 31 and 32 run parallel to each other, but their outlet end portions 31′ and 32′, respectively, diverge so as to permit successive expansion of the articles passing between them. Furthermore the lengths of the two belt conveyors are chosen such that the heat sealing seam of tube S with certainty will have had time to cool and to attain sufficient strength before the articles have expanded to the extent that they subject the tube to substantial strain.

It should be noted that not only are the articles O themselves fed in between the belt conveyors 31 and 32 but also tube S which encircles said articles and which at the outlet end of nozzle 10 has a cross section which the precompressed articles only partly fill out. Thus, the mutual distance A2 (FIG. 2) between the two belt conveyors 31 and 32 is matched in such manner to the distance A1 between the belt conveyors 13 and 14 in nozzle 10, with the last-mentioned distance corresponding to the thickness (height) of the precompressed articles, that it is not until between the diverging outlet end portions 31' and 32' of belt cohveyors 31 and 32 that the articles attain such thickness T that they completely fill out the cross section of tube S.

Figure 2:
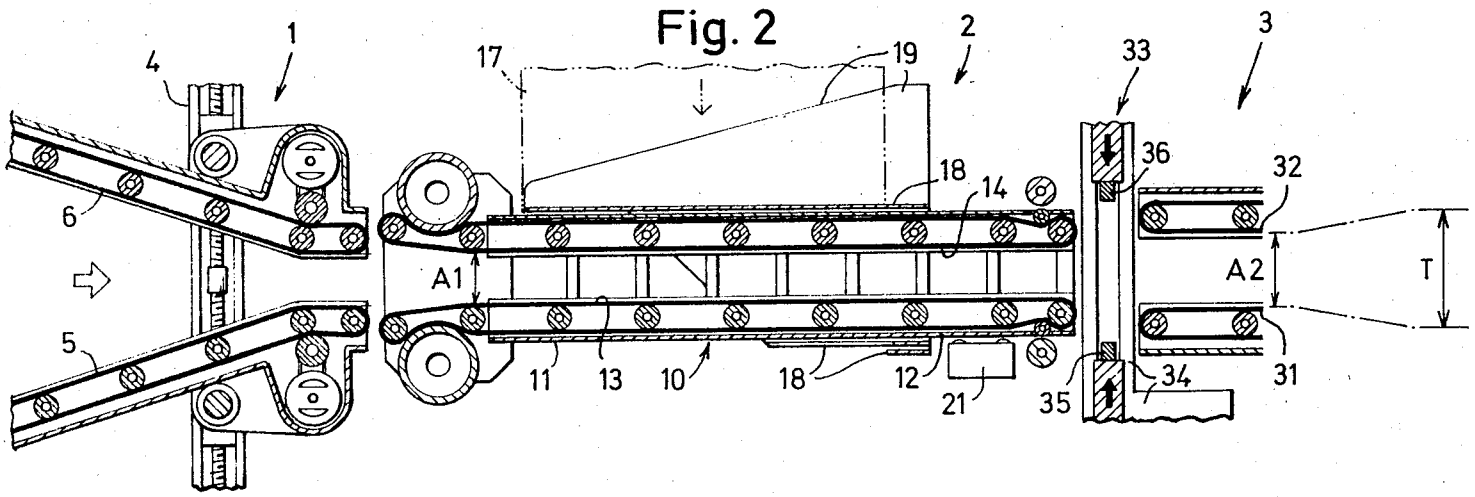
FIG. 2 is a partly shortened and simplified longitudinal section through the means included in the apparatus for precompressing the articles, for shaping the casing-forming tube, and for introducing the articles into the latter.

In order to enable individual packaging of the articles O in closed casings W formed of tube S the apparatus shown in the drawing is supplemented with means 33 known per se for sealing and severing the tube S between the introduced articles. As is indicated in FIG. 2 these known means 33 comprise jaws 35 and 36 which are displaceable vertically towards and away from each other in a frame 34 and which when they approach each other on opposite sides of the tube compress the latter so as to provide two parallel transverse heat sealing seams and a severing of the tube between them. The completed packages will then substantially have the appearance shown in FIG. 8, wherein it should be noted that this figure shows the packages turned upside down, whereby in addition to the transverse heat sealing seams 37 and 38 also the longitudinal heat sealing seam 39 is visible.

The advantage of placing the means 33 between apparatus sections 2 and 3 is that in such case the transverse heat sealing seams 37 and 38 are also relieved of strain during a long enough period for them to achieve sufficient strength. The articles may thereby be introduced into the tube with smaller mutual spacings, whereby some saving of casing material is achieved.

As has been mentioned earlier apparatus section 2 is movable along rails 8 in the transverse direction of the apparatus in the illustrated case. This permits apparatus section 2 to be easily replaced by a similar apparatus section 2' (FIG. 7) which comprises the same two groups of means for shaping a tube and for introducing articles into the same but in which these means are adapted to articles of other cross section in their precompressed state and state of completed packaging, respectively. Of course when necessary a plurality of these mutually replaceable apparatus sections may be included in the system on the condition that the two stationary apparatus sections 1 and 3 can be utilized for precompressing and controlling the expansion, respectively, of all of the various articles.

The functioning of the apparatus should be apparent from the description given above of the design of the apparatus. Resiliently compressible articles, for example bodies of mineral wool or piles of mineral wool mats, are fed into apparatus section 1 at appropriate time intervals and are precompressed in said section to a thickness (height) which is smaller than the contemplated final one. The precompressed articles are transferred to apparatus section 2 in which they are advanced with retained precompression further into the tube formed of the film web. Enclosed in this tube the articles are transferred to apparatus section 3 in which their expansion to the volume determined by the tube is delayed sufficiently long time for the heat sealed seams of the tube to attain enough strength so as not to rupture under the strain caused by the expansion forces of the articles.

The critical phase in the operation of the apparatus is when the articles introduced into the newly formed tube are transferred between apparatus sections 2 and 3, i.e. between the outlet end of nozzle 10 and the position in which belt conveyors 31 and 32 take over. It is important that the free distance there be so short that the articles 0 when entering between belt conveyors 31 and 32 still have a volume which is sufficiently small not to fill out tube S. Thus, said distance is dependent of the characteristics of the material of the articles and of the speed of operation of the apparatus.

When as in the illustrated example the apparatus is provided with means for creating transverse heat sealing seams 37, 38 between the articles introduced into the tube it is advantageous to design the drive means of the belt conveyors 31 and 32 in such manner that their driving operation can be interrupted intermittently and, if desired, in such manner that their feed direction can temporarily be reversed. In this manner the mutual spacing between two articles introduced into the tube after each other is reduced in connection with the heat sealing blocks 35 and 36 beginning to function, which additionally reduces the strain on the tube and on the transverse heat sealing seams.

The circumstance that the two belt conveyors 31 and 32 in consequence of their diverging outlet end portions 31' and 32' only permit a fairly slow and controlled expansion of the articles until they reach a volume completely filling out the tube naturally also assists in keeping the strain on the casings W formed by the tube at a minimum. Thus the apparatus does not set up any extreme requirements with regard to the thickness and strength of the plastic film forming the tube or with regard to the strength of the heat sealing seams.

It should be apparent that the casing-forming tube alternatively can be made of a heat sealable laminate or of any appropriate pliable sheet instead of a plastic film. It should furthermore be apparent that all of the sections 1, 2 and 3, respectively, of the apparatus can be stationary and that sections 1 and 2 in such case can be combined into a unit wherein belt conveyors 13 and 14 in nozzle 10 simply can be extensions of belt conveyors 5 and 6, namely if the packaging of the articles always can be carried out in a tube having one and the same cross section.

I claim:

1. An apparatus for packaging discrete and resiliently compressible articles of substantially uniform and generally rectagular shape in a compressed state, said apparatus comprising in combination;

(a) article compressing conveyor means having an inlet end and an outlet end for advancing in mutually spaced succession the discrete articles between said inlet and outlet ends while materially reducing the dimension of each article in a direction perpendicular to the direction of advance thereof;

(b) an elongate, rigid nozzle structure having an inlet end and an outlet end and surrounding an open-ended, straight passageway of generally rectangular cross section for the compressed articles emanating from the outlet end of said article compressing conveyor means, said nozzle structure being supported only near its inlet end in a manner to present a freely extending outlet end portion of substantial length having an outer cross-sectional contour which is of substantially uniform size and shape throughout said free length;

(c) a pair of cooperating and synchronously driven endless belt conveyors extending longitudinally through said nozzle structure and close to opposite walls of said passageway therein up to the outlet end of said nozzle structure, those portions of said two belt conveyors extending through said free outlet end portion of said nozzle structure being located entirely inside the latter, said two belt conveyors being operative to advance the compressed articles emanating from said article compressing conveyor means through said nozzle structure while maintaining their reduced sizes;

(d) tube forming means for forming outside and around said free outlet end portion of said nozzle structure and from a continuously supplied web of flexible, heat-sealable wrapping material a continuous, longitudinally sealed tube adapted to receive therein at spaced intervals the compressed articles discharged through the outlet end of said nozzle structure, said tube forming means comprising a web-folding plow device embracing said free outlet end portion of the nozzle structure in closely spaced relationship thereto for causing the wrapping web to successively surround said outlet end portion and the longitudinal margins of the web to meet in overlapping relationship, and heat-sealing means for successively sealing together the overlapping longitudinal margins of the web while the same is still surrounding said outlet end portion of the nozzle structure;

(e) a double-belt discharge conveyor having an inlet end facing the outlet end of said nozzle structure in spaced relationship thereto and being operative to receive and further advance the tube coming from the outside of said nozzle structure as well as the compressed articles coming from the inside thereof and being surrounded by said tube, said discharge conveyor being adapted to maintain over a considerable length of path a sufficient compression of said articles to prevent them from completely filling up the interior cross section of said tube and from thus exerting expansion forces thereon; and (f) means located in the vicinity of the outlet end of said nozzle structure for selectively feeding forward over said nozzle outlet end the tube formed around said outlet end portion of the nozzle structure, said tube feeding means comprising two transversely extending feed rollers rotatably mounted inside said nozzle structure close to opposite walls of said passageway therein and being driven by the respective ones of said two endless belt conveyors in said passageway, said feed rollers being exposed to the outside of said nozzle structure through corresponding slots in said walls; two idling pressure rollers, one for each of said feed rollers and coextensive therewith, rotatably and movably mounted outside said nozzle structure in a manner to let the tube formed around said outlet end portion of the nozzle structure pass freely between the latter and said pressure rollers; and means for selectively moving both of said pressure rollers towards the respective ones of said feed rollers in order to make the tube engage the latter for thus effecting feeding of the tube.

2. The apparatus as recited in claim 1 wherein between the outlet end of said nozzle structure and the inlet end of said discharge conveyor are provided tube closing means comprising heat-sealing jaws movable towards and away from each other and operative to produce transversely extending heat-sealed seams in said tube between said compressed articles therein.

3. The apparatus as recited in claim 1 wherein between the outlet end of said nozzle structure and the inlet end of said discharge conveyor are provided tube severing means.

4. The apparatus as recited in claim 1 wherein said discharge conveyor is designed in a manner to permit gradual expansion of the passing compressed articles.

* * * * *